US005539937A

United States Patent [19]

Barefoot

[11] Patent Number: 5,539,937

[45] Date of Patent: Jul. 30, 1996

[54] LID INTEGRATED DEODORIZER FOR TOILETS

[76] Inventor: Russell E. Barefoot, 1041 Wharncliffe Rd., Duncan, B.C., Canada, V9L 2K6

[21] Appl. No.: 127,866

[22] Filed: Sep. 27, 1993

[51] Int. Cl.[6] ..... E03D 9/052

[52] U.S. Cl. ..... 4/213; 4/217; 4/347

[58] Field of Search ..... 4/347, 348, 352, 4/213, 217

[56] References Cited

U.S. PATENT DOCUMENTS

| | | | |
|---|---|---|---|
| 2,849,727 | 9/1958 | Bollinger et al. | 4/217 |
| 3,659,296 | 5/1972 | Stamper | 4/217 |
| 3,689,944 | 9/1972 | Clayton | 4/213 |
| 4,344,194 | 8/1982 | Pearson | 4/217 |
| 4,586,201 | 5/1986 | Todd, Jr. | 4/217 |
| 4,853,981 | 8/1989 | Hunnicott, Jr. | 4/213 |
| 5,079,783 | 1/1992 | Haletsky et al. | 4/352 |

FOREIGN PATENT DOCUMENTS

| | | | |
|---|---|---|---|
| 06404 | 6/1990 | WIPO | 4/217 |

*Primary Examiner*—Henry J. Recla
*Assistant Examiner*—Charles R. Eloshway

[57] ABSTRACT

In a device for eliminating odors from a toilet bowl, a seat and lid appurtenance houses an internal air passage leading from the toilet bowl to the ambient atmosphere. A central lid extension (42 and 64) functions as a backrest and a housing for a motorized fan. A battery housed within the seat energizes the fan which draws foul air from the bowl through a filter for deodorization. Lid vertical instability is overcome through the combination of lid coupling valve (30) and pintles (28) which provides independent and separate seat and lid hinging systems.

21 Claims, 5 Drawing Sheets

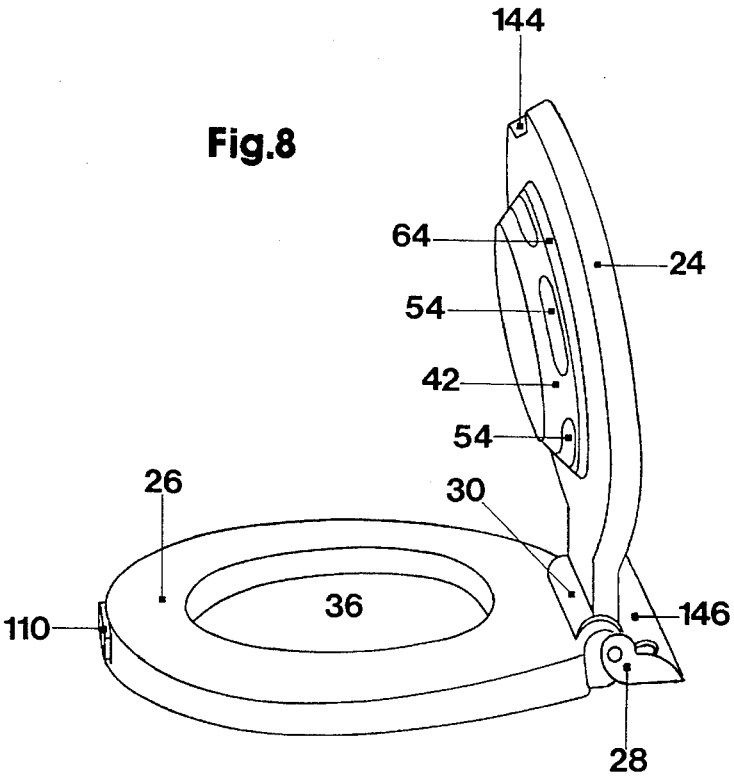
Fig.8
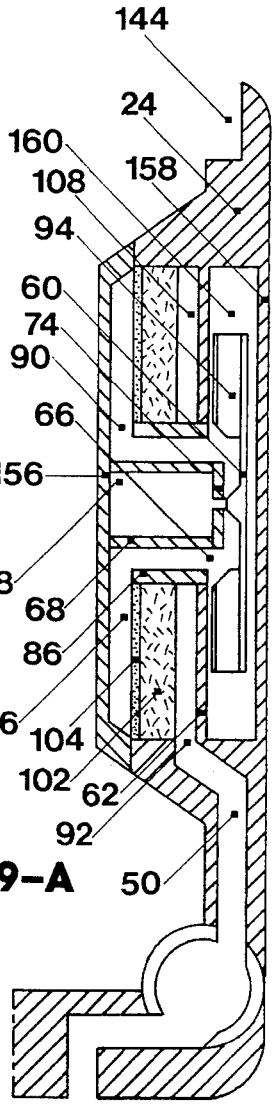
Fig.9-A
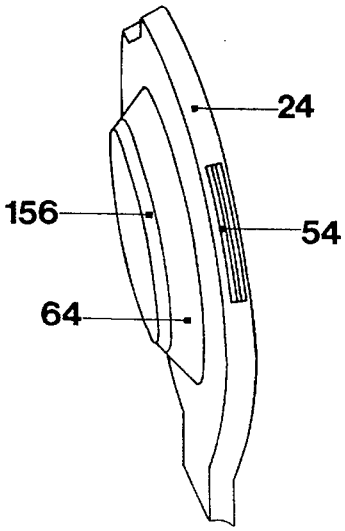
Fig.9-B

LID INTEGRATED DEODORIZER FOR TOILETS

BACKGROUND—FIELD OF THE INVENTION

The present invention relates to toilet deodorizing devices. More particularly, the present invention relates to self-contained toilet deodorizing devices, wherein the elements required to eliminate the mephitic odors present in a toilet bowl are incorporated into a combination toilet bowl seat and lid appurtenance.

BACKGROUND—DESCRIPTION OF THE PRIOR ART

Related known prior art devices are disclosed in the following Canadian patents: 1045305, 1045306, 1082852, 1102958, 1109604, 1179801, 1240103, 1252255, and 1268004.

Related known prior art devices are disclosed in the following American patents: U.S. Pat. Nos. 1,972,076, 2,105,794, 2,151,138, 2,988,756, 3,108,289, 3,386,109, 3,436,767, 3,469,267, 3,491,382, 3,501,784, 3,533,112, 3,585,651, 3,599,253, 3,600,724, 3,626,554, 3,691,568, 3,733,619, 3,740,772, 3,763,505, 3,781,923, 3,790,970, 3,816,073, 3,857,119, 3,887,949, 3,913,150, 3,916,459, 3,939,506, 3,953,901, 3,999,225, 4,025,325, 4,094,023, 4,103,370, 4,125,906, 4,133,060, 4,153,956, 4,165,544, 4,168,553, 4,174,545, 4,175,293, 4,200,940, 4,222,129, 4,301,555, 4,365,361, 4,402,091, 4,433,441, 4,442,555, 4,493,117, 4,494,255, 4,556,999, 4,701,966, 4,726,078, and 4,748,698.

Most of the aforesaid patents disclose devices comprising one or more of the following primary structural impediments which preclude successful commercialization:

1. An unbalanced or unsightly appearance.
2. Exorbitant fabrication costs.
3. A need for toilet structural modification.
4. A need for professional installation.
5. Inefficient operation.

Closest known prior art devices are disclosed in American patents U.S. Pat. Nos. 4,344,194, 4,586,201, and 4,853,981, and in Canadian patent 9072577. Such devices have a number of equivalent elements which have been assigned various names. Such devices share common structure with the present invention, said common structure comprising:

- a seat hinged at a rearward edge for raising and lowering, the seat housing a seat conduit in communication with the bowl;
- a lid hinged at a rearward edge for raising and lowering, the lid housing a lid conduit in communication with the ambient atmosphere;
- means for coupling the seat conduit to the lid conduit thereby providing a device conduit extending from the interior of the bowl to the ambient atmosphere;
- ventilating means, for example a motorized fan, integrated into the lid conduit for drawing air from the bowl, through the device conduit, to the ambient atmosphere;
- a filter integrated into the device for deodorizing the air as it is drawn through the device conduit and;
- means for energizing the ventilating means.

The closest prior art devices comprise several of the following secondary structural impediments which preclude successful commercialization:

6. Utilization of a low profile motor resulting in increased fabrication costs and reduced torque.
7. Restrictive coupling means between the seat conduit and the lid conduit resulting in reduced airflow.
8. Indirect coupling means between the seat conduit and the lid conduit resulting in reduced efficiency.
9. Heterodox filter exposure wherein air traverses the filter perpendicular to its lowest dimension resulting in reduced airflow and efficiency.
10. Utilization of indirect fan/motor coupling system (for example a belt) resulting in increased fabrication costs and reduced service life.
11. Utilization of complex switch systems resulting in increased fabrication costs and reduced service life.
12. Structural integrity compromises forced by spatial constraints.
13. Unbalanced appearance as a result of excessive lid thickness.
14. Seat and lid vertical instability as a result of their rotation about a common axis and excessive lid thickness,
15. Forward lid tapering to conceal excessive lid thickness, which results in occupant discomfort when the lid is used as a stool.
16. Forward lid tapering which precludes the addition of a suitably recessed handle to assist in raising the lid.
17. Excessive lid weight as a result of electrical cells being disposed within the lid. The excessive weight increasing the possibility of damage to the motorized fan if the lid falls from the raised position.
18. Deficient filter accessibility,
19. Utilization of a lid design wherein the underside does not provide a suitable backrest for the occupant (A deficiency also commonly associated with standard toilet bowl lids).

OBJECTS AND ADVANTAGES

One object of the invention is to provide a toilet deodorizing device which may substantially overcome the aforesaid impediments.

A further object of the invention is to provide a toilet deodorizing device in which a perfume agent is provided to redolently enhance the deodorized air.

A further object of the invention is to provide a toilet deodorizing device in which the motor is protected against moisture damage.

A further object of the invention is to provide a toilet deodorizing device in which the motor is protected from shock.

A further object of the invention is to provide a toilet deodorizing device in which an electrical jack is provided for coupling the device to a power supply or battery charger.

A further object of the invention is to provide a toilet deodorizing device in which a desiccation gap is provided for limiting the formation of mildew between the seat and the bowl.

A further object of the invention is to provide a toilet deodorizing device in which the seat, the lid, and the coupling means may be fabricated by plastic injection molding methods.

A further object of the invention is to provide a toilet deodorizing device in which a relatively stationary route is provided for electrical conductors passing between the seat and the lid.

According to one aspect, the invention consists of a toilet deodorizing device for use with a toilet having a bowl comprising an upper rim, and a rearward flange defining a pair of spaced bores adjacent the bowl.

The device comprises a toilet bowl seat fixed in hinged manner adjacent a rearward edge for rotation about a horizontal axis. The seat comprises an inner edge defining a hole. The seat further comprises portions defining a seat air passage. The seat further comprises underside portions defining an air intake port. The intake port is in communication with the seat passage and the interior of the bowl. The seat further comprises rearward portions defining an air discharge port. The discharge port is in communication with the seat passage. The intake port, the seat passage, and the discharge port cooperate to provide a seat conduit.

The device further comprises a toilet bowl lid fixed in hinged manner adjacent a rearward edge for rotation about a horizontal axis. Portions of an exterior edge of the lid may define a recessed handle to facilitate raising and lowering. The upper surface of the lid may be substantially parallel to the upper surface of the seat when the lid is proximate to the seat. The lid comprises portions defining a lid air passage. Exterior portions of the lid defining at least one air discharge orifice in communication with the lid passage and the ambient atmosphere. The lid further comprises rearward portions defining an air intake orifice in communication with the lid passage. The lid passage, the intake orifice, and the discharge orifice cooperate to provide a lid conduit.

The seat and the lid may be fixed in hinged manner for independent motion about disassociated horizontal axes.

The device further comprises a means for coupling the discharge port to the intake orifice; thereby providing a device conduit extending from the interior of the bowl to the ambient atmosphere.

The device further comprises a prominent extension projecting from the undersurface of the lid. The extension may be a backrest when the lid is vertically oriented. Portions of the lid adjacent the extension may have a thickness less than the thickness of the seat. The extension may be positioned to intersect the upper surface plane of the seat when the lid is proximate to the seat. The extension may be coincident with at least a portion of the hole when the lid is proximate to the seat.

The extension comprises portions defining an internal cavity. The internal cavity may extend laterally within the interior of the lid whereby its volume may be increased.

The internal cavity is integrated into the device conduit. The extension may further comprise a service cap.

The device further comprises a means for ventilating. The ventilating means comprising a motorized fan housed within the internal cavity for inducing an airflow through the device conduit. The motorized fan may consist of a direct current motor and a centrifugal fan.

The device may further comprise an imperforate divider. The divider partitioning the internal cavity, thereby providing a pair of adjoining sub-cavities. The sub-cavities being integrated into the device conduit. The divider may have portions defining an opening conjugating the sub-cavities. The opening providing the sole device internal communication between the sub-cavities.

The device may further comprise a removable cover. The cover may be completely removable or it may be hinged to facilitate displacement. The cover may be disposed in flush manner within an upper surface of the lid and form an airtight seal therewith. The cover may be contiguous with a first of the sub-cavities and provide access thereto. The cover and the divider may be substantially parallel and may define the diametric limits of the first sub-cavity. The cover may have a substantially greater cross sectional area than the divider. (In an alternate embodiment, in which the internet cavity and the elements and sub-cavities housed therein are inverted, a distal portion of the extension may be detachable. The detachable portion may function as and replace the cover.)

Interior portions of the first sub-cavity may define a cavity intake duct communicating with the lid passage and the intake orifice. The first sub-cavity may comprise the direct current motor. The motor may comprise a drive shaft. The motor may be positioned adjacent or may traverse the opening.

The toilet deodorizing device may further comprise a substantially tubular motor housing disposed within the first sub-cavity. A portion of the housing may traverse the opening. The housing may comprise a substantially circular end plate. A central portion of the plate may define a plate bore having a diameter greater than the diameter of the shaft. The motor may be disposed within the housing and mounted on the plate, the shaft traversing the plate bore. Rubber bushings may be interposed between the motor and the plate to reduce audible vibration and to insulate the motor against shock. The housing may further comprise a pair of rigid diverging supports. The distal ends of the supports may be affixed to the inner surface of a substantially tubular support ring mounted on the divider adjacent the opening. The support ring circumscribes the opening whereby the housing is rigidly supported within the support ring adjacent to and/or within the opening. The support ring may be imperforate. Interior portions of the support ring may, in cooperation with exterior portions of both the housing and the supports, define a pair of airflow ducts. The cover may form a seal against the housing diametric to the plate thereby shielding the motor from excess humidity. The axial height of the support ring may be less than the axial height of the housing, whereby an airflow gap is provided between the support ring and the cover. The airflow gap providing communication between the first sub-cavity and the airflow ducts. The airflow gap and the airflow ducts conjugating the sub-cavities.

The cavity intake duct may be remotely situated relative to the airflow gap within the first sub-cavity.

A portion of the shaft may be coincident with a second of the sub-cavities. The second sub-cavity may comprise the centrifugal fan. The second sub-cavity may be in communication with the discharge orifice and the ambient atmosphere. The service cap may provide access to the second sub-cavity and the centrifugal fan.

The centrifugal fan may comprise blades and a central hub. The hub may comprise portions defining an axial bore. The axial bore may have a diameter greater than the diameter of the shaft, whereby the centrifugal fan may be rigidly mounted on the shaft for rotation by the motor. The blades may be backwardly curved. The blades may further be closed by a shroud thereby increasing fan efficiency by limiting inter-blade circulation.

The device further comprises means for deodorizing the air as it flows through the device conduit. The device may have a perfume agent integrated into the device conduit downstream of the deodorizing means for redolently enhancing the deodorized air.

The deodorizing means may comprise an annular filter disposed within the first sub-cavity. The filter may comprise activated carbon or an equivalent absorbant. The filter may circumscribe the support ring. The filter may be interposed between the cavity intake duct and the airflow gap. The filter may be substantially parallel to the divider and spaced therefrom; the filter and the divider defining a dispersing cavity in communication with the cavity intake duct.

The perfume agent may be interposed between the filter and the airflow gap. The perfume agent may be substantially parallel to the cover and spaced therefrom; the perfume agent and the cover defining a coalescing cavity in communication with the airflow gap. Air passing from the dispersing cavity to the coalescing cavity must traverse the filter and the perfume agent. The filter and the perfume agent being traversed axially.

The device further comprises a means for delivering electrical energy to the motorized fan, for example electrical conductors.

The device may further comprise an electrical switch disposed within an exterior edge of the seat for activating the ventilating means.

The device may further comprise an electrical jack disposed within an exterior edge of the seat for coupling the seat to a power supply, for example a standard power adaptor. The conductors coupling the jack to the switch and the ventilating means whereby actuation of the switch energizes the ventilating means inducing an airflow from the bowl, through the device conduit, to the ambient atmosphere.

The device may further comprise a desiccation gap defined by the seat and the rim for reducing the formation of mildew. The desiccation gap may have a height less than 2 cm.

The device may further comprise a pair of spaced pintles. The pintles may be mounted on a bracket. The bracket may comprise portions defining a pair of bracket bores positioned to align with the spaced bores. The bracket may be mounted on the flange adjacent a rearward edge of the seat by fasteners, for example bolts. Each of the fasteners traversing one of the bracket bores and one of the spaced bores.

The device further comprises portions adjacent a rearward edge of the seat defining a pair of lateral coaxial bores. The lateral coaxial bores may be threaded and may circumscribe a pair of axial posts. The posts may be threaded for engaging the lateral coaxial bores.

The pintles may further comprise portions defining a pair of coaxial pintle bores. The pintle bores having diameters greater than the diameters of the posts. The pintle bores are positioned to align with and circumscribe the posts whereby the seat may be positioned between and mounted in hinged manner on the pintles; the posts provide a pivotal axis about which the seat may be rotated.

The seat and the lid may be made of a durable plastic material.

According to another aspect, the invention consists of a toilet deodorizing device for use with a toilet having a bowl comprises an upper rim, and a rearward flange defining a pair of spaced bores adjacent the bowl.

The device comprises a toilet seat mounted in hinged manner adjacent a rearward edge to facilitate movement between substantially horizontal and substantially vertical positions. The seat may comprise an electrical switch disposed within an exterior edge. The seat may further comprise an electrical jack disposed within an exterior edge for coupling the seat to a power supply. The seat comprises portions defining a seat conduit.

The device may further comprise a desiccation gap defined by the seat and the rim for reducing the formation of mildew. The desiccation gap may have a height less than 2 cm.

The seat conduit comprises an intake port in communication with the interior of the bowl. The seat conduit further comprises a discharge port disposed in a rearward surface of the seat. The seat conduit further comprises a seat air passage in communication with the intake port and the discharge port.

The device further comprises a toilet bowl lid mounted in hinged manner adjacent a rearward edge to facilitate movement between substantially horizontal and substantially vertical positions. The thickness of the lid may be less than the thickness of the seat. Portions of an exterior edge of the lid may define a recessed handle to facilitate raising and lowering. The upper surface of the lid may be substantially parallel to the upper surface of the seat when the lid is proximate to the seat. The lid comprises portions defining a lid conduit.

The seat and the lid may be mounted in hinged manner for movement about disassociated horizontal axes.

The lid conduit comprises an intake orifice disposed in a rearward surface. The lid conduit further comprises at least one discharge orifice in communication with the ambient atmosphere. The lid conduit further comprises a lid air passage in communication with the intake orifice and the discharge orifice.

The device further comprises means for coupling the seat conduit to the lid conduit whereby at least one device conduit is provided extending from the interior of the bowl to the ambient atmosphere.

The device further comprises means for ventilating integrated in to the lid conduit for inducing air movement through the device conduit.

The device further comprises means for generating electrical energy housed within the seat for energizing the ventilating means. The generating means may comprise a battery of electrical cells.

The device further comprises means for conveying the electrical energy from the generating means to the ventilating means for example electrical conductors.

The switch may be connected in series with the battery and the ventilating means whereby actuation of the switch activates the ventilating means. The jack may be connected by conductors to the battery thereby providing energy for the charging thereof.

The device further comprises a filter integrated into the device to remove mephitic gasses from the air as it is induced through the device conduit.

The seat and the lid may be made of a durable plastic material.

According to another aspect, the invention consists of a toilet deodorizing device for use with a toilet having a bowl comprising an upper rim, and a rearward flange defining a pair of spaced bores adjacent the bowl.

The device comprises a toilet seat mounted in hinged manner adjacent a rearward edge to facilitate movement between substantially horizontal and substantially vertical positions. The seat comprises an electrical switch disposed within an exterior edge. A substantially medial cleavage may bisect the seat thereby providing contiguous opposed upper and lower sections. The seat comprises portions defining a seat conduit.

The device may further comprise a desiccation gap defined by the seat and the rim for reducing the formation of mildew. The desiccation gap may have a height less than 2 cm.

The seat conduit comprises an intake port in communication with the interior of the bowl. The seat conduit further comprises a discharge port disposed in a rearward surface of the seat. The seat conduit further comprises a seat air passage in communication with the intake port and the discharge port.

The device further comprises a toilet bowl lid mounted in hinged manner adjacent a rearward edge to facilitate movement between substantially horizontal and substantially vertical positions. The thickness of the lid may be less than the thickness of the seat. The upper surface of the lid may be substantially parallel to the upper surface of the seat when the lid is proximate to the seat. Portions of an exterior edge of the lid may define a recessed handle to facilitate raising and lowering. The lid comprises positions defining a lid conduit.

The lid conduit comprises an intake orifice disposed in a rearward surface. The lid conduit further comprises at least one discharge orifice in communication with the ambient atmosphere. The lid conduit further comprises a lid air passage in communication with the intake orifice and the discharge orifice.

The device further comprises a tubular shutter valve securely mounted on a rearward portion of the lid. The valve comprises portions defining a substantially hollow interior. The valve further comprises extrados portions defining a pair of apertures in communication with the hollow interior; a first of the apertures further being in communication with the intake orifice. Diametric ends of the valve may be truncate. The diametric ends may further be closed by substantially circular end caps. Pivotal pins may project outwardly from the end caps; the pins being concentrically integral with the end caps. One of the pins may have a central portion defining an axial pin bore; the pin bore traversing the corresponding integral end cap, thereby communicating with the hollow interior of the valve. The pin bore provides a relatively stationary route for electrical conductors passing between the seat and the lid.

The device further comprises rearward portions of the seat defining a transverse trough; an inner surface of the trough defining the discharge port. The inner surface of the trough may be arcuate.

The device further comprises means for pivotally mounting the valve within the trough whereby a second of the apertures may be aligned with the discharge port, when the lid is substantially perpendicular to the seat, thereby coupling the discharge port to the intake orifice and providing at least one device conduit extending from the interior of the bowl to the ambient atmosphere.

Opposing interior end walls of the trough may comprise portions defining a pair of coaxial bearings. The bearings providing the means for pivotally mounting the valve within the trough. The trough and each of the bearings are bisected by the cleavage, whereby upper portions of the bearings are downwardly disposed within the upper section of the seat, and lower portions of the bearings are upwardly disposed within the lower section of the seat; each of the bearings circumscribes one of the pins when the valve is disposed within the trough, whereby the valve is pivotally mounted within the trough.

The device further comprises a means for ventilating for producing an airflow through the device conduit.

The device may further comprise an electrical jack disposed within an exterior edge of the seat for coupling the seat to a power supply thereby providing energy for energizing the ventilating means. The jack may be connected to the switch and the ventilating means by electrical conductors whereby actuation of the switch activates the ventilating means.

The device further comprises a filter for deodorizing the air as it flows through the device conduit.

The device may further comprise a perfume agent for redolently enhancing the air after it is deodorized.

The seat and the lid may be made of a durable plastic material. The valve and the pins may be made of a durable plastic material. The valve and the pins may comprise fused conjugate arcs to facilitate fabrication by injection molding processes. An upper portion of the fused conjugate arcs may be fabricated as an integral element of the lid prior to fusing to a lower portion of the fused conjugate arcs.

In reference to the appended drawings:

FIG. 8 illustrates a perspective view of the assembled device.

Figure 1:
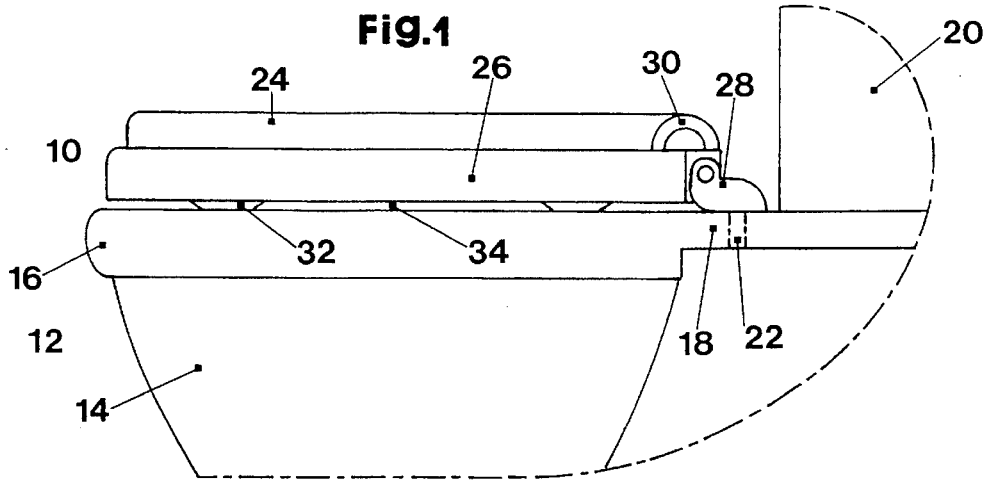
FIG. 1 illustrates a side profile of the device mounted on a standard toilet wherein the lid rests upon the seat.

FIG. 9-A illustrates a cut away side view of the lid, in an alternative embodiment of the invention, wherein the internal cavity and all elements housed therein have been inverted. (non-relevant portions of the seat, the means for mounting the seat on the flange, and the diverging supports have been omitted).

FIG. 9-B illustrates a perspective view of the lid illustrated in FIG. 9-A (the seat, the shutter valve, and the means for mounting the seat on the flange have been omitted).

NOTE. Each element in the drawings has been assigned a specific reference character or combination of characters. When comparing any one figure to another figure it may assumed that any reference character or combination of characters common to both figures specifies identical or equivalent elements.

DETAILED DESCRIPTION OF FIG. 1 THROUGH 9-B

In reference to FIG. 1 a toilet deodorizing device 10 is adapted for mounting upon a standard toilet 12; the toilet comprises a bowl 14 having an upper rim 16, a rearward flange 18, and a reservoir or tank 20. Portions of the flange define a pair of spaced bores 22 (see also FIG. 7 reference character 22). The device comprises a toilet bowl lid 24, a toilet bowl seat 26, means for mounting the seat in hinged manner on the flange for example a pair of spaced pintles 28, and means for coupling in hinged manner the lid to the seat for example a tubular shutter valve 30. The underside of the seat is provided with spacer feet 32 which create a desiccation gap 34 between the seat and the rim.

In reference to FIG. 8 the seat 26 comprises an inner edge which defines a hole 36.

Figure 2:
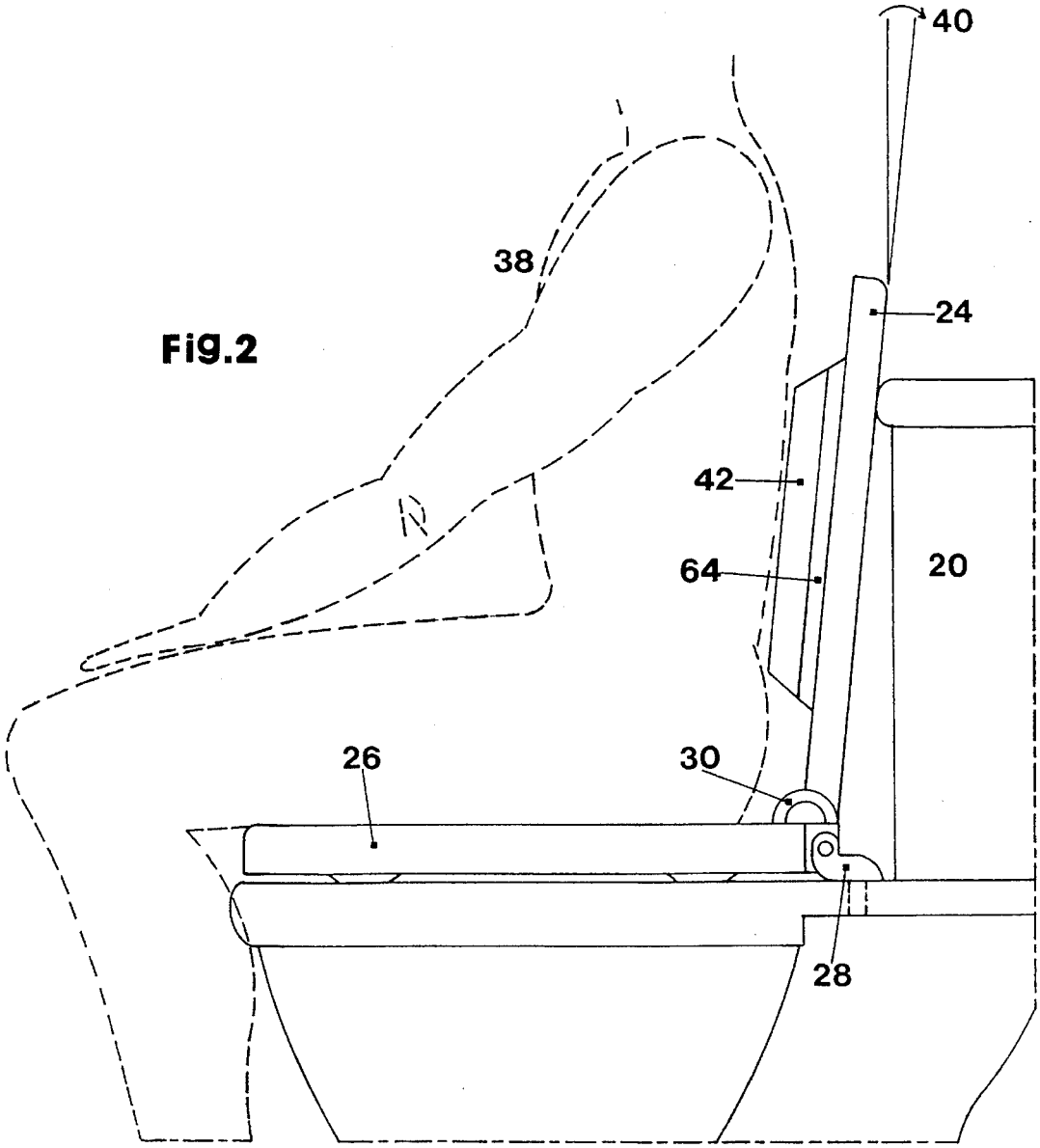
FIG. 2 illustrates a side profile of the device wherein the lid is raised and an occupant is disposed upon the seat.

In reference to FIG. 2 an occupant 38 is disposed upon the seat 26. The lid 24 rests against the tank 20 at an inclined angle 40. Vertical lid stability is determined by the degree of inclination. Greater stability has been achieved by situating the shutter valve 30 forward (towards the occupant) of the pintles 28, whereby the lid and the seat are mounted for rotation about disassociated horizontal axes. A prominent extension (42 and 64) projects from the lower surface of the lid providing a backrest for the occupant.

Figure 3:
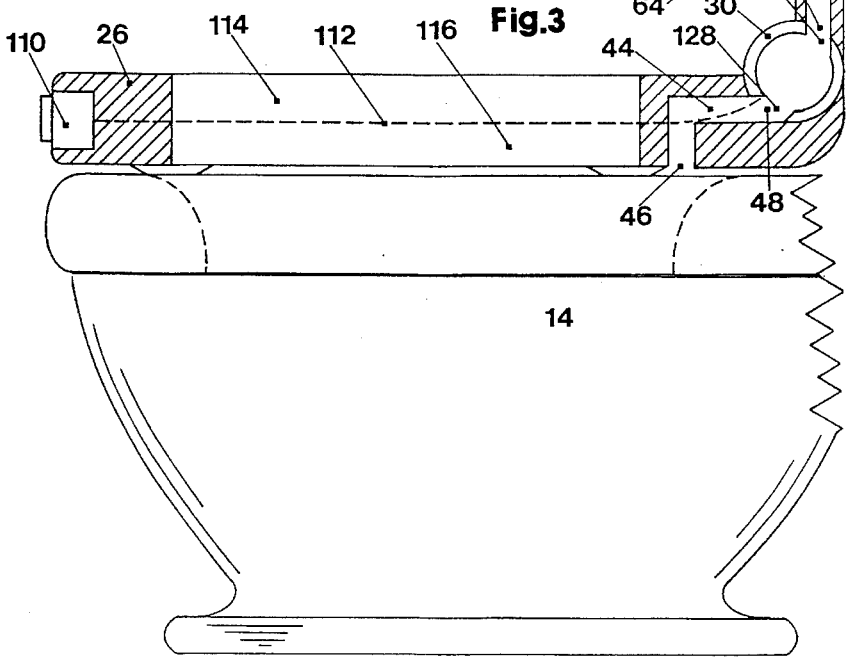
FIG. 3 illustrates a cut away side profile of the device. (the means for mounting the seat on the flange, and the diverging supports omitted).

In reference to FIG. 3 internal portions of the seat 26 define a seat air passage 44, underside portions of the seat define an air intake port 46 in communication with the interior of the bowl 14, and rearward portions of the seat define an air discharge port 48. The combination of 44, 46, and 48 provide a seat conduit. Internal portions of the lid 24 define a lid air passage 50, rearward portions of the lid define an air intake orifice 52, and exterior portions of the lid define air discharge orifices 54 in communication with the ambient atmosphere. The combination of 50, 52, and 54 provide a lid conduit. The tubular shutter valve 30 couples the seat conduit to the lid conduit. The combination of 44, 46, 48, 50, 52, 54, and 30 provide a device conduit extending from the interior of the bowl to the ambient atmosphere.

In continued reference to FIG. 3 a removeable cover 56 is disposed in flush manner within the upper surface of the lid forming an airtight seal therewith. The extension (42 and 64) and the cover define an internal cavity (the area between 42 and 56) which is integrated into the device conduit. A direct current motorized fan (58 and 60) is housed within the internal cavity for inducing an airflow from the bowl, through the device conduit, to the ambient atmosphere. The internal cavity is partitioned by an imperforate divider 62 providing a pair of adjoining sub-cavities (the area between 42 and 62) and (the area between 56 and 62). Central portions of the divider define an opening 66 (see also FIG. 6, 66) which conjugates the sub-cavities. A first of the subcavities (the area between 56 and 62) houses the direct current motor 58. The motor being disposed within a substantially tubular motor housing 68. The motor housing being sealed against the cover when the cover is in place whereby the motor is protected from moisture damage.

Figure 4:
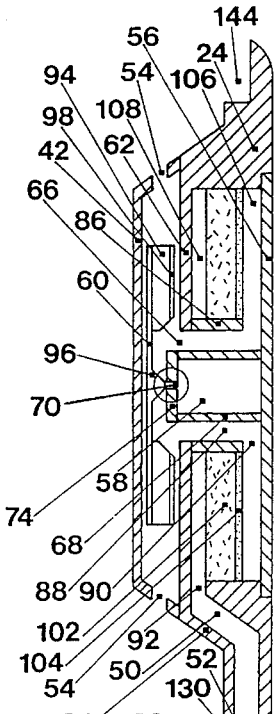
FIG. 4 illustrates a blown up perspective view of the motor, the housing, and associated elements.

In reference to FIG. 4 the motor comprises a drive shaft 70 and threaded mounting bores 72. The motor housing 68 comprises a substantially circular end plate 74, a central plate bore 76, and a pair of motor mounting bores 78. Mounting screws 80 traverse the motor mounting bores and engage the threaded mounting bores whereby the motor is mounted on the plate; the shaft traversing the central plate bore. Rubber bushings 82 insulate the plate from vibration and insulate the motor from shock if the lid should fall from the raised position. The housing further comprises rigid diverging supports 84. The distal ends of the supports being affixed to the inner surface of a substantially tubular support ring 86, whereby the motor housing is rigidly supported within the support ring. Interior portions of the support ring cooperate with exterior portions of both the housing and the supports to define airflow ducts 88.

In reference to FIG. 3 the support ring 86 is disposed within the first sub-cavity, adjacent to and circumscribing the opening. The motor housing traverses the opening whereby the end plate 74 and a section of the shaft 70 are disposed within a second of the sub-cavities (the area between 42 and 62). The axial height of the support ring is less than the axial height of the housing whereby a airflow gap 90 is provided between the support ring and the cover. The airflow gap providing communication between the first sub-cavity and the airflow ducts 88. The airflow ducts provide communication between the airflow gap and the second sub-cavity. The first sub-cavity further comprises a cavity intake duct 92.

In continued reference to FIG. 3 the second sub-cavity comprises the centrifugal fan 60. The centrifugal fan comprises blades 94 and a central hub 96. A shroud ring 98 provides added structural strength and reduces inter-blade circulation which increases fan efficiency. The blade tips are inclined in a direction away from the direction of rotation (backward inclined) for moving greater volumes of air than either forward or radial bladed fans.

Figure 5:
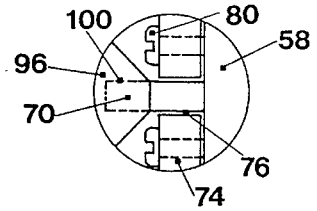
FIG. 5 illustrates a blown up view of the centrifugal fan hub and surrounding elements as designated within the focal ring in FIG. 3.
Figure 5:
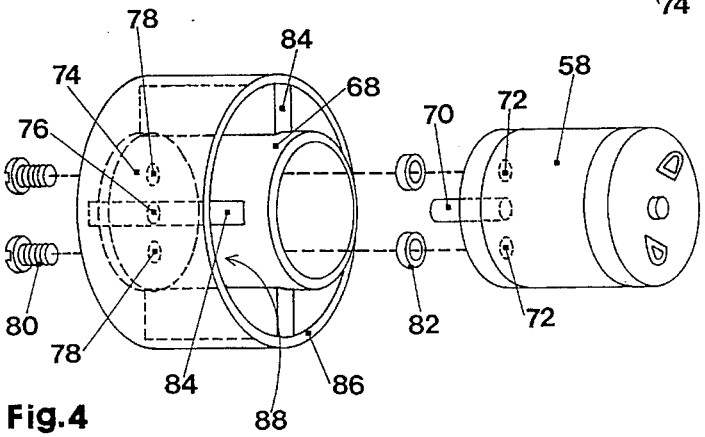

In reference to FIG. 5 the hub 96 defines an axial bore 100 having a diameter greater than the diameter of the shaft 70 whereby the centrifugal fan may be mounted on the shaft for rotation by the motor 58.

Figure 6:
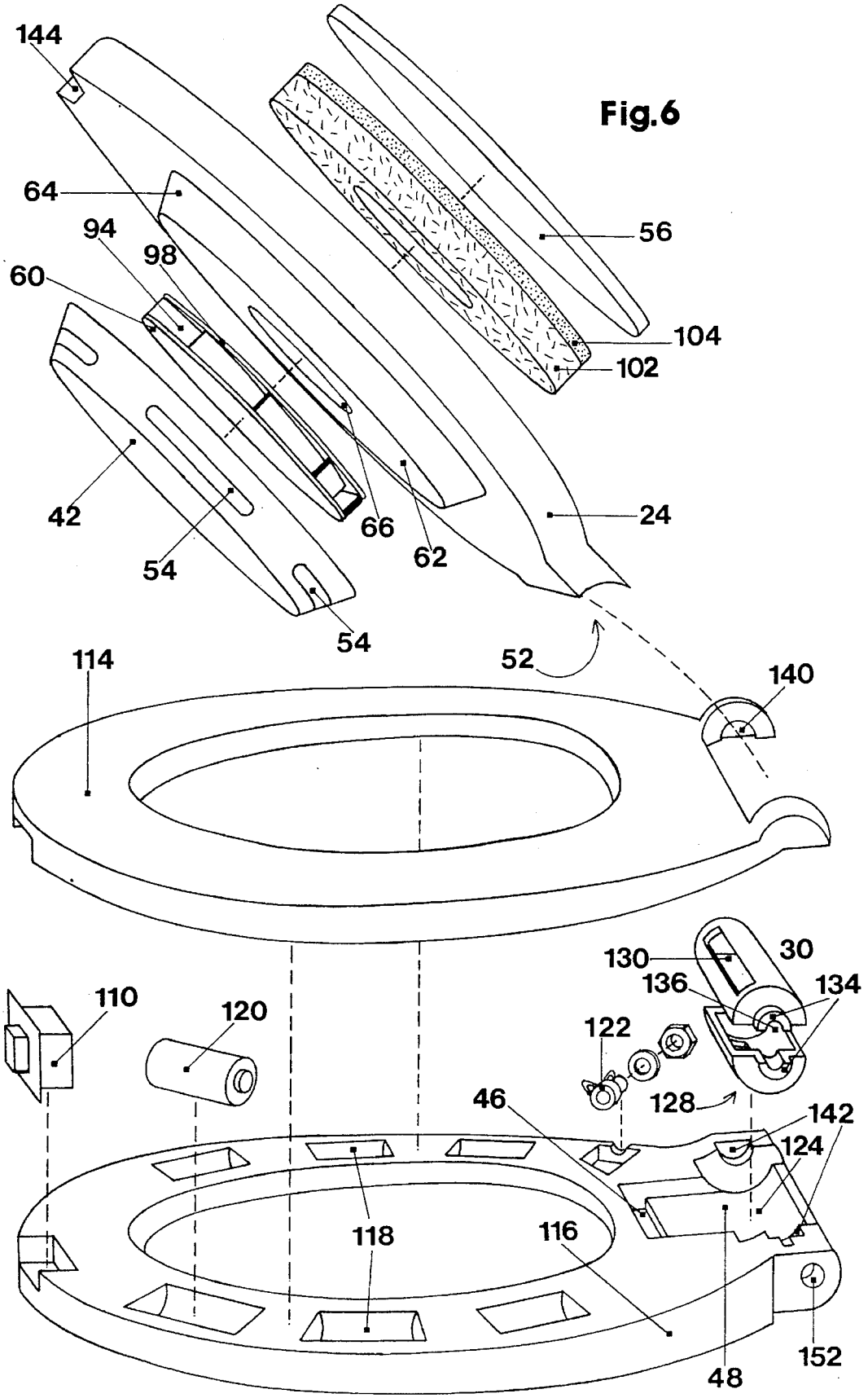
FIG. 6 illustrates an exploded perspective view of the device. (the means for mounting the seat on the flange have been omitted, in addition, all elements illustrated in FIG. 4 have been omitted)

In reference to FIG. 3 the first sub-cavity further comprises an annular activated carbon filter 102 disposed between the cavity intake duct and the airflow gap and circumscribing the support ring (see also FIG. 6, 102). A perfume agent 104 superimposes the filter adjacent the airflow gap. The perfume agent and the cover define a coalescing cavity 106. The filter and the divider define a dispersing cavity 108.

In continued reference to FIG. 3 the seat further comprises an electrical switch 110. A medial cleavage 112 bisects the seat providing contiguous opposing upper and lower sections 114 and 116.

In reference to FIG. 6 the lower section of the seat 116 comprises the lower halves of cell compartments 118. The upper halves of the compartments (not shown) are disposed within the upper section of the seat 114. Electrical cells 120 (one shown) are connected by electrical conductors (not shown) to provide a battery for energizing the motor (not shown). The cells are of secondary or rechargeable construction. The battery is connected to the switch 110 by electrical conductors (not shown). An electrical jack 122 is disposed within an exterior edge of the seat for coupling the battery to a standard battery charger (not shown). The jack is connected to the battery by electrical conductors (not shown) whereby the cells may be charged.

In an alternate embodiment (not shown) the cells may be excluded; the jack being connected to the switch and the motor, whereby the motor may be energized by coupling the jack to a standard power adaptor (not shown).

In continued reference to FIG. 6 a transverse trough 124 is defined by rearward portions of the lower section. An inner surface of the trough defines the discharge port 48. The shutter valve 30 is adapted for seating within the trough.

Figure 7:
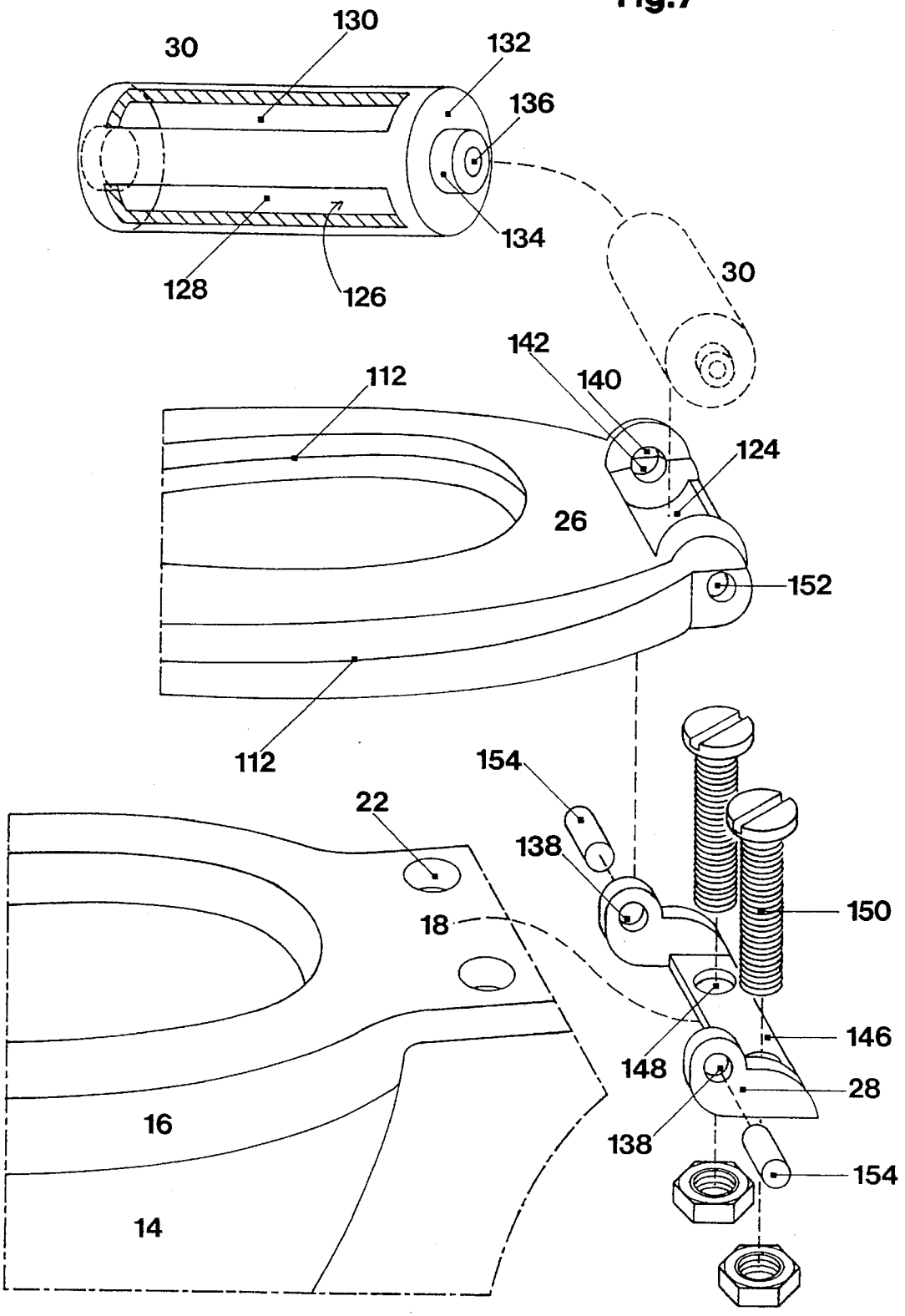
FIG. 7 illustrates an exploded perspective view of the means for mounting the seat on the bowl and a detached view of the shutter valve. (the lid and non-relevant portions of the seat and the toilet have been omitted)

In reference to FIG. 7 the shutter valve 30 comprises a hollow interior 126, a pair of apertures 128 and 130, a pair of circular end caps 132 (one shown), and a pair of pivotal pins 134 (one shown). One of the pins has portions defining an axial pin bore 136. The pin bore traversing the corresponding end cap and providing a relatively stationary route for conductors (not shown) passing between the seat and the lid.

In continued reference to FIG. 7 a means for pivotally mounting the valve within the trough for example coaxial bearings (140 and 142, one shown) are provided. The cleavage 112 bisects the bearings whereby upper portions of the bearings 140 are downwardly disposed within the upper section of the seat, and lower portions of the bearings 142 are upwardly disposed within the lower section of the seat.

In reference to FIG. 6 the shutter valve 30 comprises fused conjugate arcs (shown separated). The pivotal pins 134 (one shown) are interposed between the upper and lower portions of the bearings 140 and 142, whereby the pins are freely circumscribed by the bearings providing a pivotal mount for the valve and the lid when FIG. 6 is assembled.

In reference to FIG. 3 and FIG. 6 the valve is securely mounted upon a rearward portion of the lid 24 whereby a first of the apertures 130 is in communication with the intake orifice 52 and a second of the apertures 128 is in communication with the discharge port 48.

In continued reference to FIG. 3 and FIG. 6 a recessed handle 144 is provided to facilitate the raising and lowering of the lid.

In continued reference to FIG. 3 and FIG. 6 the extension (42 and 64) comprises a service cap 42 and an extension base 64. The service cap comprises the discharge orifices 54. The service cap provides access to the centrifugal fan 60 and the second sub-cavity (the area between 42 and 64).

In reference to FIG. 7 the spaced pintles 28 are mounted on a bracket 146 having bracket bores 148. The bracket bores align with the spaced bores 22 whereby the bracket may be mounted on the flange 18 and rigidly held in place by bolts 150. Rearward portions of the seat define a pair of lateral coaxial bores 152 (one shown). The lateral coaxial bores having a relatively shallow depth whereby they do not communicate with either the transverse trough 124 or the bearings (140 and 142). The pintles 28 have portions defining a pair of coaxial pintle bores 138 positioned to align with the lateral coaxial bores. Axial posts 154 traverse the pintle bores and engage the lateral coaxial bores whereby the seat 26 is securely mounted on the flange and may be rotated about the axial posts.

In reference to FIG. 9-A the internal cavity (see FIG. 3 the area between 42 and 56) and all its internal elements and cavities have been inverted. The need for the removable cover (FIG. 3, 56) is eliminated. Detachable portion 156 provides access to the filter 102 and the perfume agent 104. The second sub-cavity (shown in FIG. 3, the area between 42 and 62) is replaced by discharge cavity 160 which is defined by an upper surface of the lid 158 and the divider 62. The discharge cavity extends laterally within the lid (perpendicular to the page) and communicates with the discharge orifices (FIG. 9-B, 54)

In reference to FIG. 9-B the discharge orifices 54 are disposed within an exterior edge of the seat.

In reference to FIG. 3 actuation of the switch 110 causes air and mephitic odors suspended therein to flow from the interior of the bowl 14; through the seat conduit (the combination of 44, 46, and 48); through the shutter valve 56; through the intake orifice 52; through the lid air passage 50; through the cavity intake duct 92; through the dispersing cavity 108, wherein the air and the odors are evenly dispersed across the filter surface; through the filter 102 wherein the odors are removed; through the perfume agent 104, wherein the air is redolently enhanced; through the coalescing cavity 106, wherein the air is coalesced; through the airflow gap 90; through the airflow ducts 88; through the centrifugal fan 60; through the second sub-cavity (the area between 42 and 62); and finally through the discharge orifices 54 to the ambient atmosphere.

The embodiments of the invention in which an exclusive property or privilege is claimed are defined as follows:

1. A toilet deodorizing device for use with a toilet having a bowl comprising an upper rim, an a rearward flange defining a pair of spaced bores adjacent the bowl, the device comprising:

a. a toilet bowl seat mounted in hinged manner adjacent a rearward edge for movement between substantially horizontal and substantially vertical positions, the seat having portions defining a seat conduit comprising:
   an intake port in communication with an interior of the bowl;
   a discharge port disposed in a rearward surface of the seat; and
   a seat air passage in communication with the intake port and the discharge port;

b. a toilet bowl lid mounted in hinged manner adjacent a rearward edge to facilitate movement between substantially horizontal and substantially vertical positions, the lid having portions defining a lid conduit comprising:
   an intake orifice disposed in a rearward surface;
   a discharge orifice in communication with the ambient atmosphere; and
   a lid air passage in communication with the intake orifice and the discharge orifice;

c. a tubular shutter valve securely mounted on a rearward portion of the lid, the valve comprising:
   portions defining a substantially hollow interior; and
   extrados defining a pair of apertures in communication with the hollow interior, a first of the apertures further being in communication with the intake orifice;

d. a rearward portions of the seat defining transverse through, an inner surface of the trough defining the discharge port;

e. means for pivotally mounting the valve within the through whereby a second of the apertures may be aligned with the discharge port, thereby coupling the discharge port to the intake orifice and providing at least one device conduit extending from the interior of the bowl to the ambient atmosphere;

f. means for producing an airflow through the device conduit;

g. a filter for deodorizing the air as it flows through the device conduit.

h. a prominent extension projecting from an undersurface of the lid, the extension being positioned to intersect an upper surface plane of the seat when the lid is proximate to the seat, the extension comprising portions defining an internal cavity, the internal cavity being intregrated into the device conduit.

2. A toilet deoderizing device as claimed in claim 1, wherein the internal cavity extends laterally within an interior of the lid whereby the volume of the internal cavity is increased.

3. A toilet deodorizing device as claimed in claim 1, wherein a desiccation gap is defined by the seat and the rim for reducing the formation of mildew, the desiccation gap having a height less than 2 cm.

4. A toilet deodorizing device as claimed in claim 1 wherein the motorized fan comprises a direct current motor and a centrifugal fan, and the extension is coicident with at least a portion of the hole when the lid is proximate to the seat, the extension functioning as a backrest when the lid is vertically oriented.

5. A toilet deodorizing device as claimed in claim 4 wherein an imperforate divider partitions the internal cavity providing a pair of adjoining sub-cavities, the divider comprising portions defining an opening conjugating the sub-cavities, the opening providing the sole internal communication between the sub-cavities, a first of the sub-cavities housing the direct current motor situated within the opening, the motor comprising a drive shaft, a portion of the shaft being coincident with a second of the sub-cavities, the second sub-cavity housing the centrifugal fan, the centrifugal fan comprising blades and a central hub, the hub defining an axial bore for engaging the shaft, whereby the centrifugal fan may be rigidly mounted on the shaft for rotation by the motor.

6. A toilet deodorizing device as claimed in claim 5 wherein:

interior portions of the first sub-cavity defines a cavity intake duct communicating with the lid passage and the intake orifices and, the second sub-cavity is in communication with the discharge orifice and the ambient atmosphere, whereby the sub-cavities are intregrated into the device conduit and, a removable cover is contiguous with the first sub-cavity providing access thereto.

7. A toilet deodorizing device as claimed in claim 6 wherein a substantially tubular motor is disposed within the first sub-cavity, a portion of the housing traversing the opening, the housing comprising a substantially circular end plate, central portions of the plate defining a plate bore having a diameter greater than the diameter of the shaft, the motor being disposed within the housing and mounted on the plate, the shaft traversing the plate bore, the housing further comprising a pair of rigid diverging supports, distal ends of the supports being affixed to an inner surface of a substantially tubular imperforate support ring mounted on the divider adjacent the opening, the support ring circumscribing the opening whereby the housing is rigidly supported within the opening, and interior portions of the support ring, in cooperation with exterior portions of both the housing and the supports, define a pair of airflow ducts, the axial height of the support ring being less than the axial height of the housing, whereby an airflow gap is provided between the support ring and the cover, the airflow gap providing communication between the first sub-cavity and the airflow ducts, the airflow gap and the airflow ducts conjugating the sub-cavities.

8. A toilet deodorizing device as claimed in claim 7 wherein the deodorizing means comprises an annular filter disposed within the first sub-cavity, the filter circumscribing the support ring, the filter comprising an odor absorbing material.

9. A toilet deodorizing device as claimed in claim 8 wherein the filter is interposed between the cavity intake duct and the airflow gap, the filter being substantially parallel to the divider and the spaced therefrom, the filter and the divider defining a dispersing cavity in communication with the cavity intake duct, a perfume agent is disposed between the filter and the airflow gap, the perfume agent being substantially parallel to the cover and spaced therefrom, the perfume agent and the cover defining a coalescing cavity in communication with the airflow gap, whereby air passing from the dispersing cavity to the coalescing cavity must traverse the filter and the perfume agent, the filter and the perfume agent being traversed axially.

10. A toilet deodorizing device as claimed in claim 5 wherein:

interior portions of the first sub-cavity define a cavity intake duct communicating with the lid passage and the intake orifice and, the second sub-cavity is in communication with the discharge orifice and the ambient atmosphere, whereby the sub-cavities are integrated into the device conduit and, a distal portion of the extension is detachable, the detachable portion being contiguous with the first sub-cavity and providing access thereto.

11. A toilet deodorizing device as claimed in claim 1 wherein a perfume agent is intregrated into the device conduit downstream of the deodorizing means for redolently enhancing the deodorized air.

12. A toilet deodorizing device for use with a toilet having a bowl and a rearward flange defining a pair of spaced bores adjacent the bowl, the device comprising:

a. a toilet bowl seat mounted in hinged manner adjacent a rearward edge to facilitate movement between substantially horizontal and substantially vertical positions, the seat having portions defining a seat conduit comprising:
   an intake port in communication with an interior of the bowl;
   a discharge port disposed in a rearward surface of the seat; and
   a seat air passage in communication with the intake port and the discharge port;

b. a toilet bowl lid mounted in hinged manner adjacent a rearward edge to facilitate movement between substantially horizontal and substantially vertical position, the lid having portions defining a lid conduit comprising:
   an intake orifice disposed in a rearward surface;
   a discharge orifice in communication with the ambient atmosphere; and
   a lid air passage in communication with the intake orifice and the discharge orifice;

c. means for coupling the seat conduit to the lid conduit whereby at least one device conduit is provided extending from the interior of the bowl to the ambient atmosphere;

d. means for ventilating the device conduit;

e. a battery of electrical cells housed within the seat for energizing the ventilating means, the battery being electrically connected to the ventilating means;

f. a filter integrated into the device conduit to remove mephitic gassesd from the air as it is induced through the device conduit.

13. A toilet deodorizing device as claimed in claim 12 wherein a prominent extension projects from an undersurface of the lid, the extension being positioned to intersect an upper surface plane of the seat when the lid is proximate to the seat, the extension comprising portions defining an internal cavity, the internal cavity being integrated into the device conduit.

14. A toilet deodorizing device as claimed in claim 12 wherein the seat and the lid are fixed in hinged manner for independent motion about disassociated horizontal axes.

15. A toilet deodorizing device for use with a toilet having a bowl comprising an upper rim, and a rearward flange defining a pair of spaced bores adjacent the bowl, the device comprising:

a. a toilet bowl seat mounted in hinged manner adjacent a rearward edge for movement between substantially horizontal and substantially vertical positions, the seat having portions defining a seat conduit comprising:
   an intake port in communication with an interior of the bowl;

a discharge port disposed in a rearward surface of the seat; and a seat air passage in communication with the intake port and the discharge port;

b. a toilet bowl lid mounted in hinged manner adjacent a rearward edge to facilitate movement between substantially horizontal and substantially vertical positions, the lid having portions defining a lid conduit comprising:

an intake orifice disposed in a rearward surface;

a discharge orifice in communication with the ambient atmosphere; and a lid air passage in communication with the intake orifice and the discharge orifice;

c. a tubular shutter valve securely mounted on a rearward portion of the lid, the valve comprising:

portions defining a substantially hollow interior; and extrados portions defining a pair of apertures in communication with the hollow interior, a first of the apertures further being in communication with the intake orifice;

d. rearward portions of the seat defining a transverse trough, an inner surface of the trough defining the discharge port;

e. means for piviotally mounting the valve within the trough whereby a second of the apertures may be aligned with the discharge port, thereby coupling the discharge port to the intake orifice and providing at least one device conduit extending from the interior of the bowl to the ambient atmosphere;

f. means for producing an airflow through the device conduit;

g. a filter for deodorizing the air as it flows through the device conduit.

16. A toilet deodorizing device as claimed in claim 15 wherein the seat and the lid are fixed in hinged manner for independent motion about disassociated horizontal axes.

17. A toilet deodorizing device as claimed in claim 16 wherein the inner surface of the trough is arcuate, the second aperture being aligned with the discharge port when the lid is positioned substantially perpendicular to the seat.

18. A toilet deodorizing device as claimed in claim 17 wherein:

diametric ends of the valve are truncate, the ends being closed by substantially circular end caps and, pivotal pins project outwardly from the end caps, the pins being concentrically integral with the end caps.

19. A toilet deodorizing device as claimed in claim 18 wherein:

a substantially medial cleavage bisects the seat, the cleavage providing contiguous opposed upper and lower sections and, opposing interior end walls of the trough define a pair of coxial bearings, each of the bearings being bisected by the cleavage whereby upper portions of the bearings are downwardly disposed within the upper section of the seat, and lower portions of the bearings are upwardly disposed within the lower section of the seat, each of the bearings circumscribing one of the pins when the valve is disposed within the trough, whereby the valve is pivotally mounted within the trough and, at least one of the pins comprises central portions defining an axial pin bore, the pin bore traversing the corresponding integral end cap, thereby communicating with the hollow interior of the valve, the pin bore providing a relatively stationary route for electrically connecting the seat to the lid.

20. A toilet deodorizing device as claimed in claim 19 wherein the valve and the pins are made of a durable plastic material, the valve and the pins further comprising fused conjugate arcs to facilitate fabrication by injection molding processes.

21. A toilet deodorizing device for use with a toilet having a bowl and a rearward flange defining a pair of spaced bores adjacent the bowl, the device comprising:

a. a toilet bowl seat comprising:

an inner edge defining a hole;

portions defining a seat air passage;

an underside portion defining an air intake port in communication with an interior of the bowl and the seat passage;

a rearward portion defining an air discharge port in communication with the seat passage, whereby the intake port, the seat passage, and the discharge port cooperate to provide a seat conduit;

rearward portions defining a transverse arcuate trough, an inner surface of the trough defining the discharge port, opposing interior end walls of the trough defining a pair of coaxial bearing;

a substantially medial cleavage bisecting the seat, the cleavage providing contiguous opposed upper and lower sections, the cleavage further bisecting the trough and the bearings, whereby upper portions of the bearings are downwardly disposed within the upper section of the seat, and lower portions of the bearings are upwardly disposed within the lower section of the seat;

a battery of electrical cells housed within the seat;

an electrical jack disposed within an exterior edge for coupling the seat to a power supply, the jack being electrically connected to the battery for supplying electrical energy thereto whereby the battery may be charged;

an electrical switch disposed within an exterior edge, the switch being electrically connected to the battery; portions adjacent a rearward edge defining a pair of lateral coxial bores, the lateral coxial bores circumscribing a pair of axial posts, the providing a pivotal axis which the seat may be rotated;

b. a toilet bowl lid comprising:

portions defining a lid air passage;

an exterior portion defining an discharge orifice in communication with the lid passage and the ambient atmosphere;

a rearward portion defining an air intake orifice in communication with the lid passage, whereby the lid passage, the intake orifice, and the discharge orifice cooperate to provide a lid conduit;

forward portions defining a recesses handle to facilitate the raising and lowering of the lid;

a prominent extension projecting from an underside of the lid, the extension being positioned to intersect an upper surface plane of the seat when the lid is proximate to the seat, the extension comprising portions defining an internal cavity;

an imperforate divider partioning the internal cavity thereby providing a pair of adjoining sub-cavities, the divider comprising portions defining an opening conjugating the sub-cavities, the opening providing the sole internal communication between the sub-cavities, a first of the sub-cavities comprising interior portions defining a cavity intake duct communicating with the lid passage and the intake orifice, and a second of the sub-cavities comprising interior portions defining the discharge orifice, whereby the sub-cavities are intregrated into the lid conduit;

a first of the sub-cavities comprising a direct current motor, the motor being positioned within the opening and comprising a drive shaft, a section of the shaft conincident with a second of the sub-cavities, the motor being electrically connected with the battery and the switch, whereby actuating the switch energizes the motor;

the second sub-cavity comprising a centifugal fan, the centrifugal fan comprising blades and a central hub, the hub defining an axial bore for engaging the shaft, whereby the centrifugal fan may be mounted on the shaft for rotation by the motor for inducing an airflow through the lid conduit;

the extension comprising a service cap, the service cap providing access to the second sub-cavity and the centrifugal fan;

a removeable cover contiguous with the first sub-cavity and providing access thereto, the cover being substantially parallel to the divider;

a substantially tubular motor housing disposed within the first sub-cavity, a portion of the housing traversing the opening, the housing comprising a substantially circular end plate, a central portions of the plate defining a plate bore having a diameter greater than the diameter of the shaft, the motor being disposed within the housing and mounted on the plate, the shaft traversing the plate bore, the housing further comprising a pair of rigid diverging supports, distal ends of the supports being affixed to an inner surface of an imperforate substantially tubular support ring mounted on the divider adjacent the opening, the support ring circumscribing the opening whereby the housing is rigidly supported adjacent and within the opening, and interior portions of the support ring, in cooperation with exterior portions of both the housing and the supports, define a pair of airflow ducts, the support ring further having an axial height less than the axial height of the housing, whereby an airflow gap is providing between the support ring and the cover, the airflow gap providing communication between the first sub-cavity and the airflow ducts, the airflow gap and the airflow ducts conjugating the sub-cavities, the cavity intake duct being remotely situated relative to the airflow gap;

an annular carbon filter interposed between the cavity intake duct and the airflow gap, the filter being substantially parallel to the divider and spaced therefrom, the filter and the divider defining a dispersing cavity in communication with the cavity intake duct;

a perfume agent interposed between the filter and the airflow gap, the perfume agent being substantially parallel to the cover and spaced therefrom, the perfume agent and the cover defining a coalescing cavity in communication with the airflow gap, air passing from the dispersing cavity to the coalescing cavity must be transverse the filter and the perfume agent, the filter and the perfume agent being traversed axially;

c. a pair of spaced pintles, the pintles being mounted on a bracket, the bracket comprising portions defining a pair of bracket bores positioned to align with the spaced bores, whereby the bracket may be mounted on the flange by fasteners, each of the fasteners traversing one of the bracket bores and one of the spaced bores, the pintles comprising portions defining a pair of coaxial pintle bores, the pintle bores having diameters greater than the diameters of the posts, the pintle bores being positioned to align with and circumscribe the posts whereby the seat may be positioned between and mounted in hinged manner on the pintles;

d. a substantially tubular shutter valve mounted on a rearward portion of the lid, the valve further being piviotally mounted within the trough, the valve comprising:

portions defining a substantially hollow interior;

extrados portions defining a pair of apertures in communication with the hollow interior, a first of the apertures further being in communication with the intake orifice;

truncate diametric ends of the valve being closed by substantially circular end caps, a concentrically integral pivotal pin projecting outwardly from each of the end caps, at least one of the pins comprising central portions defining an axial pin bore, the pin bore traversing the corresponding integral end cap and communicating with the hollow interior, the pin bore providing a relatively stationary route for electrically connecting the seat to the lid;

the valve being disposed within the trough whereby the pins are freely circumscribed by the bearings providing a pivotal mount for the valve and the lid;

a second of the apertures communicating with the discharge port when the lid is substantially perpendicular to the seat, thereby coupling the seat conduit to the lid conduit providing a device conduit extending from the interior of the bowl to the ambient atmosphere;

Actuation of the switch causing air and mephitic odors suspended therein to flow from the interior of the bowl; through the seat conduit; through the shutter valve; through the intake orifice; through the lid air passage; through the cavity intake duct; through the dispersing cavity, wherein the air and the odors are evenly dispersed across the filter surface; through the filter, wherein the odes are removed; through the perfume agent, wherein the air is redolently enchanted; through the coalescing cavity, wherein the air is coalesced; through the airflow gap; through the airflow ducts; through the centrifugal fan; through the second sub-cavity; and finally through the discharge orifice to the ambient atmosphere.

* * * * *